US006506147B2

(12) United States Patent
Eustace et al.

(10) Patent No.: US 6,506,147 B2
(45) Date of Patent: Jan. 14, 2003

(54) MOVABLE CANOPY WARMER FOR AN INFANT CARE UNIT

(75) Inventors: David Eustace, Pipersville, PA (US); Robert M. McDonough, Hatfield, PA (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 09/733,695

(22) Filed: Dec. 8, 2000

(65) Prior Publication Data

US 2002/0032361 A1 Mar. 14, 2002

Related U.S. Application Data

(60) Provisional application No. 60/170,066, filed on Dec. 10, 1999.

(51) Int. Cl.[7] ..... A61G 11/00
(52) U.S. Cl. ..... 600/22
(58) Field of Search ..... 600/21–22; 5/97; 128/205.26

(56) References Cited

U.S. PATENT DOCUMENTS

| | | | | |
|---|---|---|---|---|
| 3,782,362 A | | 1/1974 | Puzio | |
| 3,858,570 A | | 1/1975 | Beld et al. | |
| 4,206,523 A | | 6/1980 | James | |
| 4,750,474 A | | 6/1988 | Dukham et al. | |
| 5,119,467 A | | 6/1992 | Barsky et al. | |
| 5,285,519 A | | 2/1994 | Barsky et al. | |
| 5,308,310 A | * | 5/1994 | Roff et al. | 600/21 |
| 5,453,077 A | * | 9/1995 | Donnelly et al. | 600/22 |
| 5,759,149 A | * | 6/1998 | Goldberg et al. | 600/22 |
| 6,022,310 A | | 2/2000 | Goldberg et al. | |
| 6,036,634 A | * | 3/2000 | Goldberg et al. | 600/22 |
| 6,063,020 A | | 5/2000 | Jones et al. | |
| 6,155,970 A | | 12/2000 | Dykes et al. | |
| 6,224,539 B1 | | 5/2001 | Jones et al. | |
| 6,231,499 B1 | | 5/2001 | Jones | |
| 6,296,606 B1 | * | 10/2001 | Goldberg et al. | 600/22 |

FOREIGN PATENT DOCUMENTS

| | | |
|---|---|---|
| EP | 0 291 195 | 11/1988 |
| EP | 0 308 093 | 3/1989 |
| WO | 97/11663 | 4/1997 |

OTHER PUBLICATIONS

Ohmeda, The Ohio IC Incubator, Date Unknown.

* cited by examiner

*Primary Examiner*—Kevin Shaver
*Assistant Examiner*—Joseph A. Cadugan
(74) *Attorney, Agent, or Firm*—Barnes & Thornburg

(57) ABSTRACT

An infant care unit is provided having a patient support platform, an overhead arm and a mounting assembly. The overhead arm is located generally above the platform. The mounting assembly couples the overhead arm to the platform for pivoting movement relative thereto. The pivoting movement is in a second plane that is generally parallel to a first plane which is defined by the platform.

21 Claims, 5 Drawing Sheets

MOVABLE CANOPY WARMER FOR AN INFANT CARE UNIT

RELATED APPLICATION

The present application is based upon U.S. Provisional Patent Application Ser. No. 60/170,066, filed Dec. 10, 1999, the complete disclosure of which is hereby expressly incorporated by reference.

TECHNICAL FIELD

The invention relates to infant care units of the type comprising a base with an infant-support surface above the base, and a canopy and a warmer located over the infant-support surface.

BACKGROUND AND SUMMARY

Infant care units, such as an infant incubator or warmer that includes various systems for controlling the temperature and humidity to facilitate the development of a premature infant, are known. Such units conventionally include an infant-support surface for supporting the infant and some type of overhead structure, such as a canopy, above the infant-support surface. In some cases, an isolation chamber is formed by a set of panels arranged around the infant-support surface. The canopy cooperates with these panels to enclose the isolation chamber.

It is typical in such units to provide access to the infant. For example, panels may be provided with access openings through which care givers gain access to the infant. Such units may also include canopies that have access doors to provide further access to the infant. The canopies of such units are movable away from the infant-support surface and the panels of such units are movable away from the infant-support surface to provide still further access to the infant. Some units also include heaters that provide warmth to the infant in a warmer mode. In such units, the canopies and the heaters are vertically adjustable relative to the infant-support surface.

Incubators are also known to include air circulation systems that provide controlled movement of air within the isolation chamber. The canopy is oftentimes arranged to direct the flow of air within the isolation chamber. Conventionally, this air is warmed with a heater. Heat from the warm air, however, can radiate through the canopy and into the atmosphere. In addition, heat generated by the infant can similarly radiate through the canopy. This heat loss has the potential of reducing the temperature of the infant. Furthermore, the differences in temperature between the inside and outside of the incubator may cause condensation on the surface of the conventionally transparent surfaces of the canopy. This creates an obstructed view of the infant for the care giver.

The care giver, in addition, may desire to have substantially unrestricted access to the infant and/or may wish to warm the baby directly from an overhead heater, similar to the traditional warmer, rather than warm circulating air.

Accordingly, it would be desirable to provide an infant care unit that includes a canopy that is warmed. The warmed canopy provides a barrier to prevent heat from radiating out of the incubator. The warmed canopy would also reduce condensation that might form on the surface of the canopy. In addition, it would be desirable for the canopy to be movable to a position spaced-apart or retracted from the isolation chamber for allowing unrestricted access to the infant. Furthermore, it would be desirable to provide an infant care unit that can warm the infant while the canopy is in the retracted position, similar to a conventional warmer.

Accordingly, an infant care unit is provided comprising a platform on which the infant rests and a canopy to cover the infant. A heater is positioned above the platform to heat the infant when the canopy is retracted. The heater is configured and controlled to heat the canopy when it is covering the infant to reduce radiation from the infant to the canopy. While the infant heater may be configured to heat the canopy, it will be appreciated that an auxiliary heater or heaters serving to warm the infant may also be used to heat the canopy.

In illustrative embodiments, the heater directs heat to top panels of the canopy. The canopy is also movable relative to the platform between a use position and a retracted position. The heater is configured to warm the canopy when the canopy is in the use position, and to warm the infant when the canopy is in the retracted position. In further illustrative embodiments, the heater can be a plurality of heaters. In a still further illustrative embodiment an infrared absorbing material may be applied to the canopy and the heater be an infrared heater directed toward the canopy. Other embodiments include sensors for determining the temperature of the canopy and the infant, and appropriate controls configured to warm the canopy.

Another illustrative embodiment, which comprises a heater positioned above a support to warm an infant, also includes a canopy for covering the infant having two portions. Each portion is movable between a use position to form a controlled environment and a retracted position to expose the infant. When the two portions are moved to the use position, the canopy is exposed to the heater to warm the canopy. When the two portions are moved to the retracted position, the infant is exposed to the heater to warm the infant.

A further illustrative embodiment comprises a platform for carrying the infant, a canopy cooperating with the platform and a heater spaced-apart from the canopy. The canopy defines a chamber for receiving the infant and is movable relative to the platform. The heater moves with the canopy when the canopy moves relative to the platform and is configured to warm the canopy. The canopy comprises two portions, each movable independently of the heater between a use position and a retracted position. The heater is directed toward the infant when the canopy is in the retracted position.

Additional features and advantages of the infant care unit will become apparent to those skilled in the art upon consideration of the following detailed descriptions exemplifying the best mode of carrying out the infant care unit as presently perceived.

BRIEF DESCRIPTION OF THE DRAWINGS

The illustrative apparatus will be described hereinafter with reference to the attached drawings which are given as non-limiting examples only, in which.

Corresponding reference characters indicate corresponding parts throughout the several views. The exemplification set out herein illustrates an embodiment of the apparatus, and such exemplification is not to be construed as limiting the scope of this application in any manner.

DETAILED DESCRIPTION OF THE DRAWINGS

Figure 1:
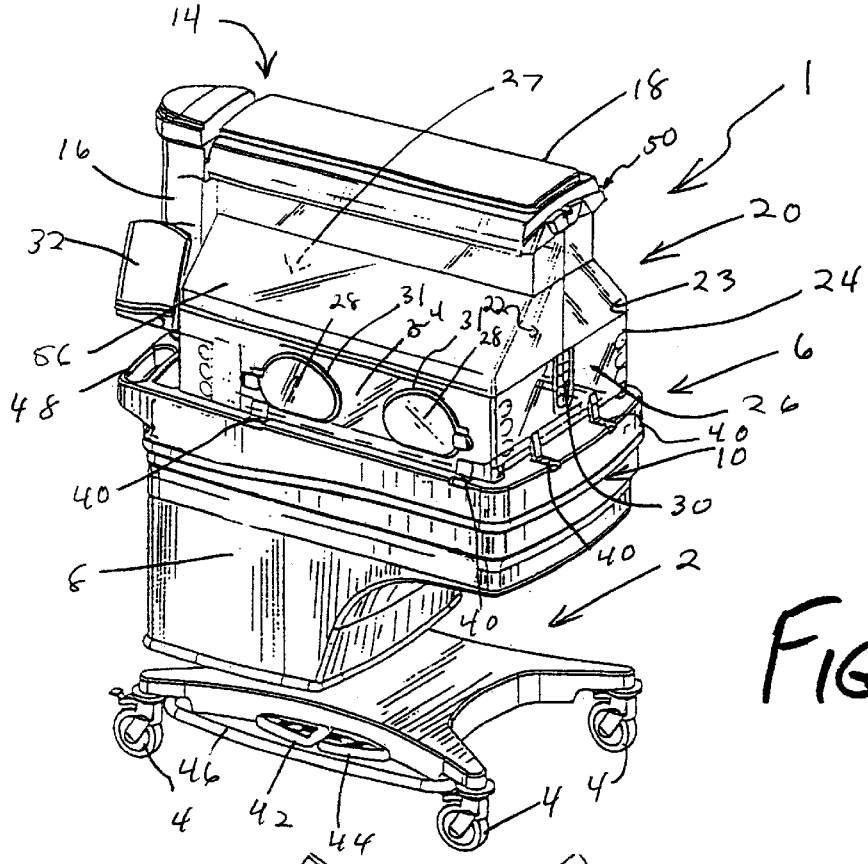
FIG. 1 is a perspective view of an infant care unit.

As shown in FIGS. 1 through 8, infant-support apparatus 1 is configured to employ either illustrated embodiments of the canopy 20 or 21, both of which are moveable between raised and lowered positions. (See, specifically, FIGS. 1, 2, 4 and 5.) Heaters 51, 53 are shown spaced-apart from and directing heat toward both embodiments of canopy 20, as shown, for example, in FIG. 1, and canopy 21, as shown, for example, in FIGS. 4 and 5, when they are in their lowered positions. Heaters 51, 53 are configured to warm the surface of both embodiments of canopy 20 or 21 to effect a temperature barrier between isolation chamber 27 and the outside environment. Such a temperature barrier prevents heat present inside chamber 27, illustratively from infant 29, or from a secondary heat source (not shown), from radiating to the outside environment. Infant 29 positioned in chamber 27 of apparatus 1, will thus, lose less body heat since such heat will not radiate to the outside environment.

Both illustrated embodiments of canopy 20 and 21 are configured to move to a raised position allowing a care giver greater access to infant 29. (See specifically, FIGS. 2 and 5.) While canopies 20 or 21 are in this raised position, heaters 51, 53 no longer direct heat to canopies 20 or 21. Consequently, the temperature barrier is lost. Heaters 51, 53, however, are configured to direct heat to infant 29. Because having either canopy 20 or 21 in the raised position allows the care giver to tend to infant 29, directing heat to infant 29 will provide warmth and comfort to infant 29 similar to a traditional warmer. The care giver may, therefore, spend more time tending to infant 29 without concern infant 29 will become chilled. In addition, with sensor 154 configured to attach to either canopy 20 or 21 and a sensor 158 attached to infant 29, the care giver will be able to monitor the temperature of either canopy 20 or 21 and infant 29 to ensure the best level of comfort to infant 29. (See FIG. 7, for example).

As shown, specifically, in FIG. 1, infant-support apparatus 1 includes a base 2, a plurality of castors 4 extending downwardly from base 2, and an infantsupporting portion or infant-support 6 supported above base 2. Infant-support 6 includes a pedestal 8 coupled to base 2 for vertical movement, a platform tub 10 supported by pedestal 8, and a mattress 11 supported above platform tub 10. (See FIGS. 6 and 7.) Mattress 11 has an upwardly facing infant-support surface 13. (See also FIGS. 6 and 7.) Infant-support apparatus 1 also includes a canopy support arm 14 including a telescoping vertical arm 16 and a horizontal overhead arm 18. As shown in FIG. 1, a canopy 20 is coupled to overhead arm 18 and is positioned to lie above platform tub 10. This illustrated embodiment of canopy 20 includes a pair of canopy halves 22, 23 coupled to overhead arm 18 for pivoting movement between a use position, shown, for example, in FIG. 1, and a retracted position, as shown in FIG. 2.

Figure 2:
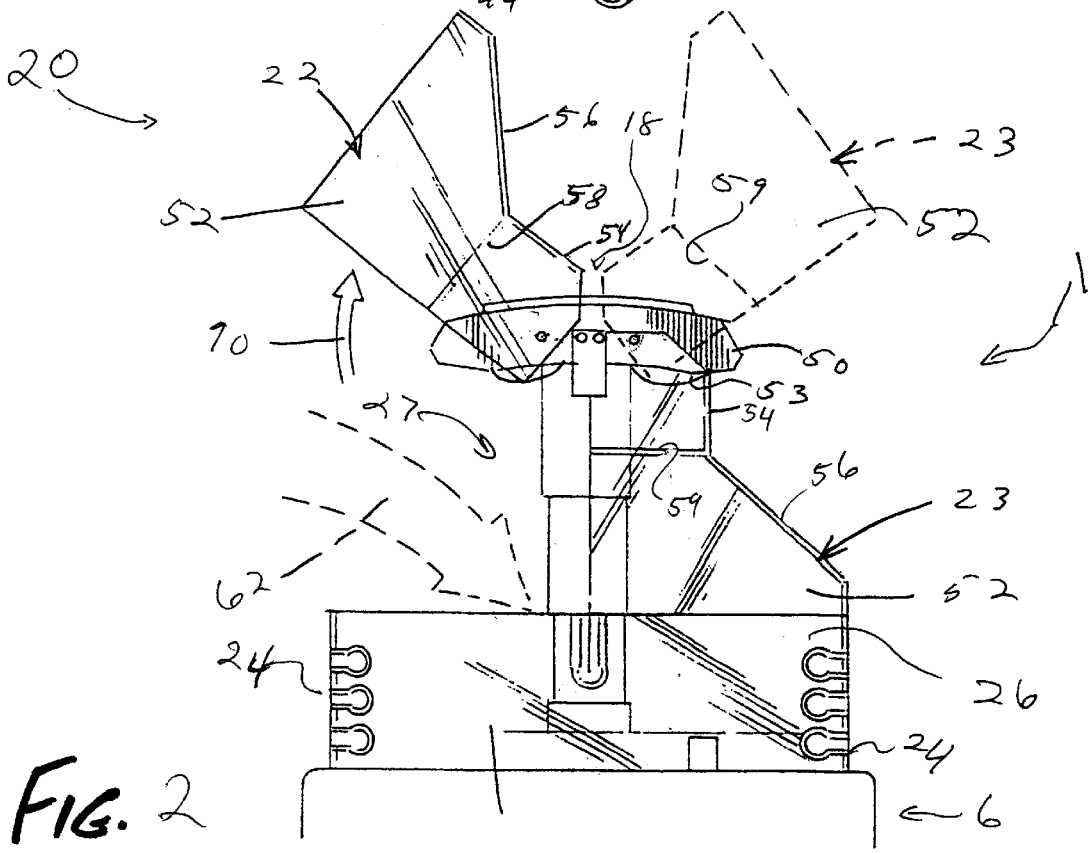
FIG. 2 is an end view showing a configuration of movable canopy halves coupled to an overhead arm assembly.

A pair of transparent side guard panels 24 and a pair of transparent end guard panels 26 extend upwardly from platform tub 10, as shown in FIGS. 1 and 2. Side guard panels 24 and end guard panels 26 cooperate with canopy halves 22, 23 to provide infant-support apparatus 1 with an isolation chamber 27. Side guard panels 24 may be formed to include a pair of access ports 31 that are normally closed by access port covers 28. Access port covers 28 can be opened to allow access to infant 29, supported by tub 10 within isolation chamber 27. Each end guard panel 26 is formed to include at least one U-shaped window and a pass-through grommet 30 positioned to lie in each U-shaped window. Wires and tubes (not shown) can be routed into the isolation chamber through pass-through grommets 30.

Figure 8:
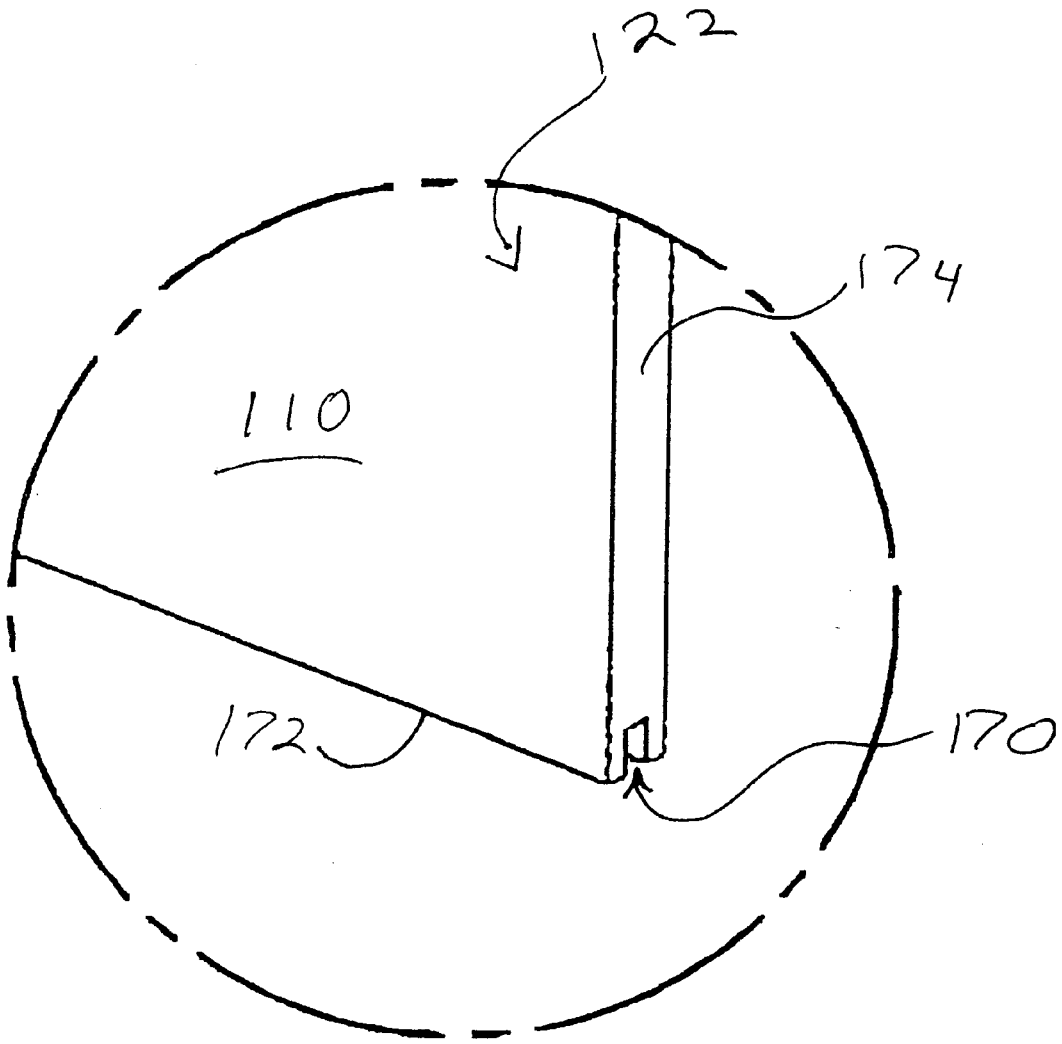
FIG. 8 is a perspective view of an edge of a canopy half taken along the portion A of FIG. 3.

To further assist in maintaining a desired temperature within chamber 27, a groove 170 is formed in lower edge 172 of end panel 110, as shown in FIG. 8, to receive or mate with the top edge of panel 26. It is contemplated that all lower edges of either canopy 20 or 21 that communicate with either panels 24 or 26 may comprise such grooves to receive or mate with the panels. Accordingly, when either canopy 20 or 21 is in its use position, and groove or grooves 170 mate with panels 24, 26, a barrier is formed between chamber 27 and the outside environment. It is contemplated, however, that the barrier formed using grooves 170 does not necessarily have to be an air-tight seal. Rather, grooves 170 simply mate with panels 24, 26 to provide a sufficient barrier between chamber 27 and the outside environment.

Hinges 40 are provided so that side guard panels 24 and one of end guard panels 26 can pivot downwardly away from canopy 20 to provide increased access to infant 29 supported by mattress 11. (See FIG. 7). Up and down buttons (not shown) can be pressed to extend and retract vertical arm 16 of canopy support arm 14, thereby raising and lowering, respectively, overhead arm 18 and canopy 20. Infant-support apparatus 1 also includes an up pedal 42 that can be depressed to raise infant-support 6 relative to base 2 and a down pedal 44 that can be depressed to lower infant-support 6 relative to base 2. Infant-support apparatus 1 includes a side bumper 46 that protects pedals 42, 44 and other components, such as base 2 and pedestal 8, from inadvertent impact. Platform tub 10 is formed to include a handle 48 on each side of canopy support arm 14. Handles 48 can be grasped by a care giver to maneuver infant-support apparatus 1 during transport.

Infant-support apparatus 1 further includes a user interface panel 32 for monitoring various systems that control the temperature of the isolation chamber, and for allowing care givers to input various control parameters into memory of a control system of infant-support apparatus 1.

Other features of infant-support apparatus 1 are discussed in detail in U.S. Pat. No. 6,022,310, titled "Canopy Adjustment Mechanisms for Thermal Support Apparatus," (the '310 patent) which is incorporated herein by reference.

Overhead arm 18 illustratively includes an overhead arm structural member having a substantially rectangular frame member and an end plate coupled to the frame member by a horizontal and vertical flange (all not shown). Examples of such structures are indicated by reference numerals 70, 72, 76, 78, respectively, and are shown in FIG. 2 of the '310 patent. The overhead arm structural member is the component of overhead arm 38 that supports the other components of overhead arm 38 in the '310 patent. Also, for example, overhead arm 38 includes a top cover 80 that overlies structural member 70 and is attached thereto in the '310 patent. Canopy halves 42 are attached to top cover 80 for pivoting movement as shown in FIGS. 7 and 8 of the '310 patent.

Figure 7:
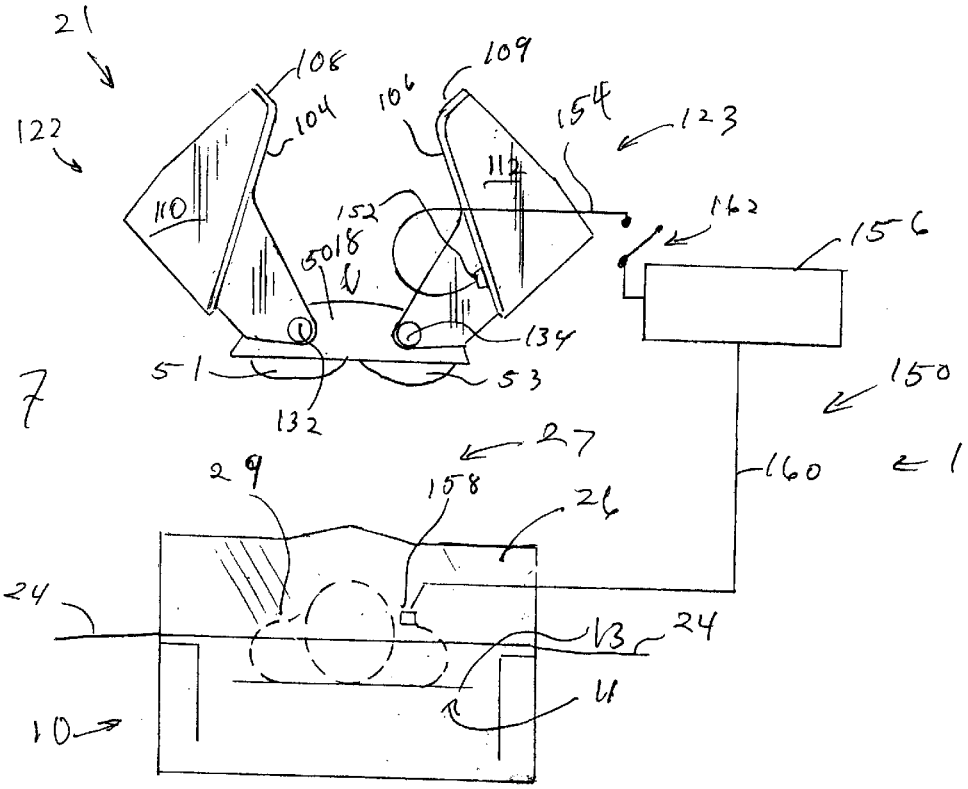
FIG. 7 is another end view of the incubator of FIG. 3 with the canopy halves in the retracted position and including temperature sensors.

Also disclosed in FIGS. 7 and 8 of the '310 patent are gas springs or dashpots 280 mounted between the canopy halves 42 and the overhead arm 38. As further disclosed in the '310 patent, when the canopy halves 42 are in their retracted position, the springs are in an extended position. Conversely, when the canopy halves 42 are in their use position, the springs are retracted. In the present application, when canopy halves 22, 23 are pivoted upwardly, as shown by arrow 60 in FIG. 2, access is provided to the infant, as illustrated by arrow 62, such as a conventional warmer.

Also disclosed in U.S. Pat. No. 6,022,310 is a pair of heater assemblies 88 coupled to overhead arm 38 below overhead arm structural member 70. Heater assemblies 88 provide warmth to an infant (such as infant 29 in the present application) supported on infant-support surface 33 as shown in the '310 patent. Heater assemblies 88 are shown extending longitudinally, and are laterally spaced-apart from one another in the '310 patent. In FIG. 2 of the present application, heaters 51, 53 are coupled to overhead arm 18 to direct heat to either canopy 20 or infant 29, depending on the position of canopy 20. Illustratively, each heater 51, 53 includes a deflector (not shown) to direct the heat towards infant-support 6.

As best shown in FIG. 2, canopy halves 22, 23 each include end panels 52 which are coupled to cover 50 by extension sections 54. Each canopy half 22, 23 also includes an angled transparent surface 56 and inwardly-extending top portions 58, 59. Top portions 58, 59 engage each other to provide an enclosure or isolation chamber 27 around infant-support surface 13 and is spaced-apart from the overhead arm 18. Therefore, overhead arm 18 does not provide a portion of isolation chamber 27. By removing overhead arm 18 from isolation chamber 27, the ability of a control system to maintain desired temperature and humidity levels within isolation chamber 27 is improved.

Illustratively, heaters 51, 53 within the overhead arm 18 in the present application may be turned on to a preset level to prewarm the panels of canopy halves 22, 23. Prewarming the panels minimizes heat loss and reduces condensation on the panels within the isolation chamber. In addition, prewarming the panels helps bring the isolation chamber 27 temperature to a desired level more rapidly when the device is adjusted from a warmer mode, in which the canopy halves 22, 23 are in the retracted position, to an incubator mode, in which the canopy halves 22, 23 are in the use position. Additional elements within tub 10 may be heated as well to help control temperatures during this transition.

Figure 3:
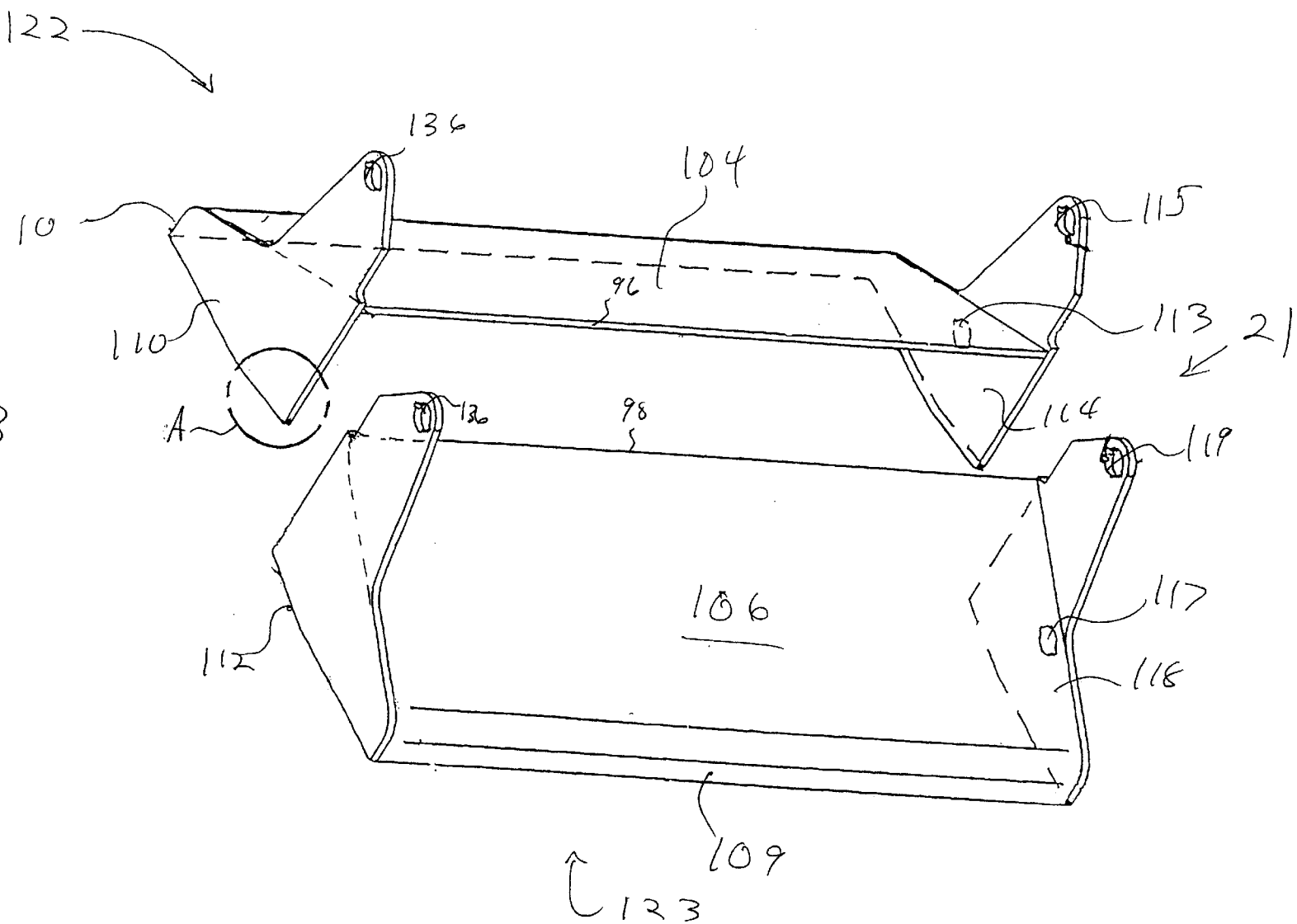
FIG. 3 is a perspective view of another configuration of the movable canopy halves.

The other configuration of the canopy is shown in FIG. 3 and is indicated by reference numeral 21. Canopy 21 is distinguishable from canopy 20 in that panels 104, 106 of canopy 21 angle upwardly, meeting at edges 96, 98, forming a vertex 105. (See, specifically, FIGS. 4 and 6.)

In the illustrated embodiment, canopy 21 is a transparent shield divided into two halves 122, 123, similar to halves 22, 23 of canopy 20. Each canopy half 122, 123 comprises panels 104, 106 angling upwardly relative to side panels 108, 109. End panels 110, 112 and 114, 118 form the end sections of canopies 122, 123, respectively. All of these panels and ends form a cavity that ultimately become part of chamber 27. In the illustrated embodiment, canopy halves 122, 123 are coupled to cover 50 via pins 132, 134, being disposed through apertures 136, 138 of end panels 110, 112, respectively. (See also FIGS. 4 and 5). It is appreciated that systems similar to those described with respect to FIGS. 7 and 8 of the '310 patent engage apertures 113, 115, and 117, 119 of end panels 114, 118, respectively, for moving halves 122, 123.

Figure 4:
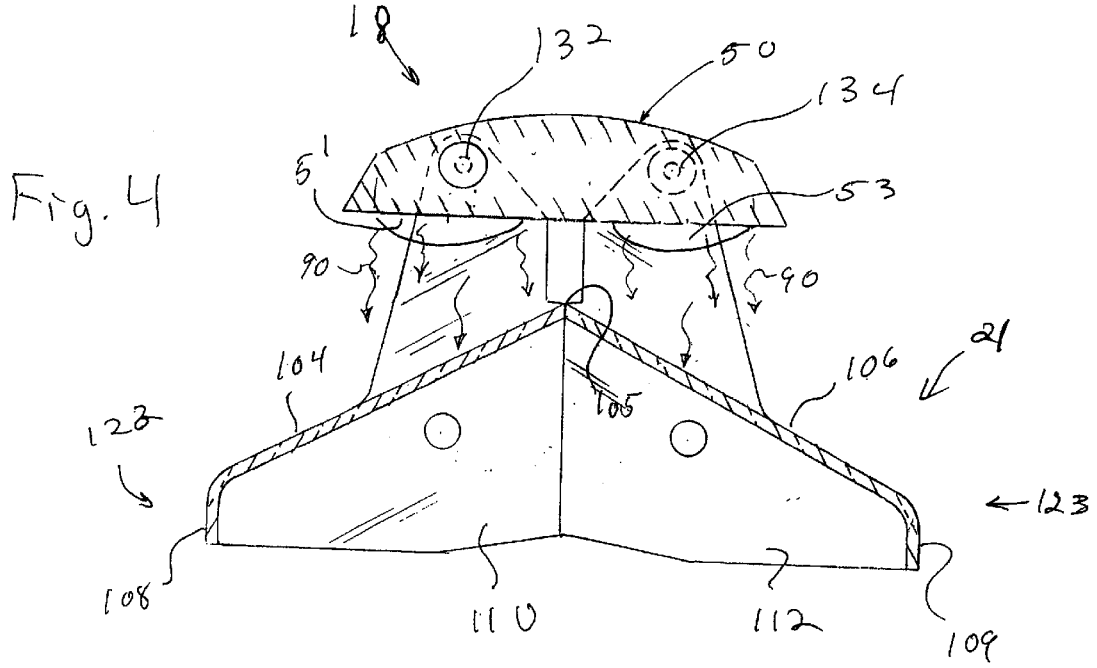
FIG. 4 is an end view showing the configuration of movable canopy halves of FIG. 3 coupled to the overhead arm assembly and moved to the use position.
Figure 5:
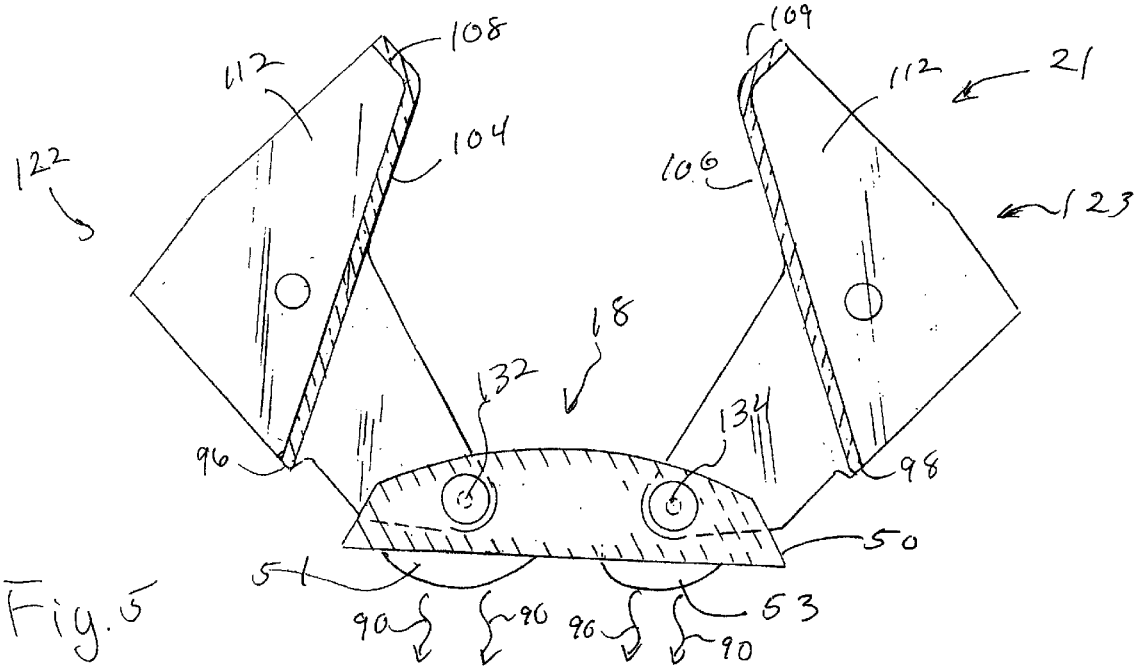
FIG. 5 is another end view of the movable canopy halves of FIG. 3 moved to the retracted position.

As shown in FIGS. 4 and 5, heaters 51, 53 are positioned within cover 50, directing heat downwardly, as indicated by reference numeral 90. When canopy 21 is in the use position, as depicted in FIG. 4, heat 90 is directed to top panels 104, 106. By heating panels 104, 106, a heat barrier is formed between the outside environment and isolation chamber 27. Heat either generated by infant 29 or by some heating mechanisms (not shown) will be contained within chamber 27. Otherwise, heat from infant 29 and/or other sources within chamber 27 may radiate out from panels 104, 106. Illustratively, either canopy 20 or 21 may have an infrared-coating material applied thereto for use with an infrared heater. In one illustrative embodiment, heaters 51, 53 may be such infrared heaters directed to either canopy 20 or 21. Radiant heat produced by these heaters is absorbed by the material applied to the canopy, thus, preventing the radiant heat from transmitting through the canopy and heating the infant. It is appreciated that the infrared absorbing material coating may be either transparent, tinted or opaque.

As shown in FIG. 5, canopy halves 122, 123 are pivoted upwardly to their raised retracted positions, exposing heaters 51, 53 to infant 29 below. (See also FIG. 7.) In this position, canopy halves 122, 123 do not obstruct heaters 51, 53 from heating infant 29 directly, in similar fashion to conventional warmers. This allows the care giver access to infant 29 without the obstruction of canopy 21, and yet, the infant still receives heat 90 and does not have to be removed and placed in a conventional warmer. It is appreciated, however, that heaters 51, 53 do not necessarily have to be the only heaters to warm either the infant or the canopy. It is contemplated, however, that heaters 51, 53 can be a single heater, either main or auxiliary heaters, and work in conjunction with other heaters either inside or outside of the canopy. In addition, such heaters 51, 53 can be convection, heated coil or other types of heating mechanisms.

Figure 6:
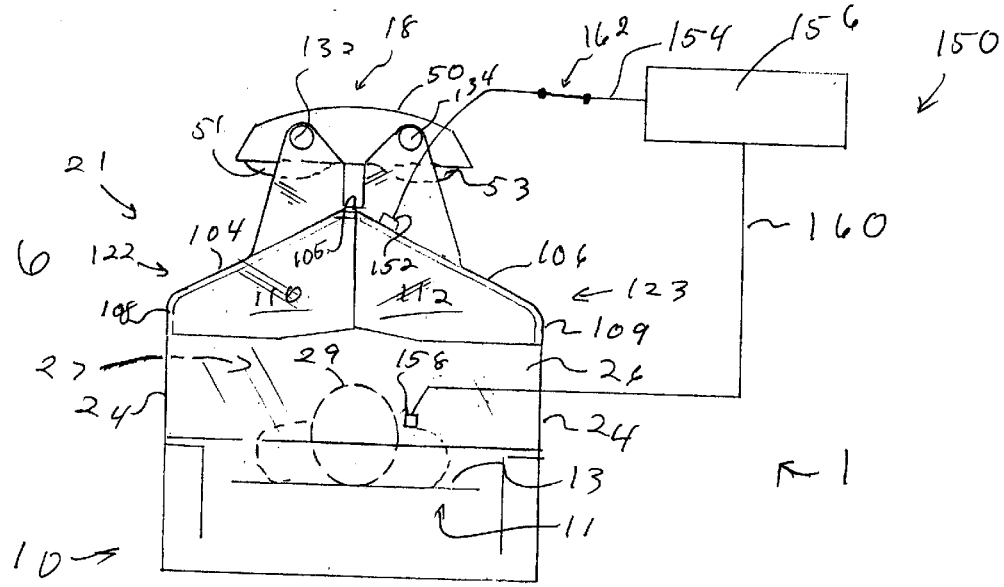
FIG. 6 is an end view of the incubator of FIG. 3 with the canopy halves in the use position and including temperature sensors.

To monitor the temperature of infant 29 and either canopy 20 or 21, a sensor system 150 is provided. (See FIGS. 6 and 7, for example.) As shown in FIG. 6, system 150 comprises a temperature sensor 152 coupled to top panel 106 for measuring the temperature of that panel. It is contemplated that such a sensor may be a thermocouple or other temperature sensing device. In addition, another temperature sensor may be coupled to top panel 104 for measuring the temperature of that panel as well. Sensor 152 is attached to a wire 154 that leads to a control apparatus 156 for transferring information to apparatus 156 which displays the temperature as well as other information about apparatus 1.

As shown in FIG. 7, sensor system 150 further includes a switch 162 that is coupled to wire 154 between sensor 152 and controller 156. Switch 162 is illustratively configured to be closed when canopy 21 is in its use position, as shown in FIG. 6, and open when canopy 21 is in its retracted position, as shown in FIG. 7. When switch 162 is in the closed position, the temperature signal may pass from sensor 152 to control apparatus 156. And conversely, when switch 162 is in the open position, the temperature signal is prevented from passing between sensor 152 and control apparatus 156. This arrangement prevents sensor 152 from taking false or unnecessary readings on panel 106 while canopy 21 is in the retracted position where such a temperature reading is irrelevant.

A second temperature sensor 158 is shown coupled to infant 29 to monitor the infant's temperature. A wire 160 is attached to sensor 158 to transfer information to control apparatus 156 for displaying the temperature of infant 29. Similar to sensor 152, sensor 158 may also be a thermocouple or other temperature sensing device. It is contemplated that other sensing devices may be included to apparatus 1. For example, sensors measuring humidity, oxygen, or other atmospheric and/or medical indicators may also be included.

Although the foregoing embodiments have been described, one skilled in the art can easily ascertain the essential characteristics of the apparatus, and various changes and modifications may be made to adapt the various uses and characteristics without departing from the spirit and scope of this application, as described by the claims which follow.

What is claimed is:

1. An infant care unit comprising a platform on which an infant may rests, a vertically telescoping arm supporting a retractable canopy at various heights to cover the infant, a heater overlying the platform to directly radiate heat to the platform on which the infant may rest when the canopy is retracted, and the heater being configured and controlled to directly radiate heat onto the canopy when it is covering the infant to reduce radiation from the infant to the canopy.

2. The infant care unit of claim 1, wherein an isolation chamber within which the infant may rest is formed by the canopy and the platform, and wherein the heater is positioned outside the isolation chamber.

3. The infant care unit of claim 2, wherein the heater is positioned above the canopy when the canopy is in the use position.

4. The infant care unit of claim 2, further comprising a monitor control for the infant care unit including a sensor for determining the temperature within the isolation chamber.

5. The infant care unit of claim 1, wherein the canopy has a top panel and the heater is directed to the top panel.

6. The infant care unit of claim 1, wherein the canopy comprises an infrared-absorbing material applied thereon and the heater is a radiant heater directed toward the canopy.

7. The infant care unit of claim 1, wherein the canopy is movable relative to the platform between a use position covering the infant and a retracted position.

8. The infant care unit of claim 1, further comprising a monitor control for the infant care unit including a sensor coupled to the canopy for determining the temperature of the canopy.

9. The infant care unit of claim 1, further comprising a monitor control for the infant care unit including a sensor for determining the temperature of the infant.

10. The infant care unit of claim 1, further comprising one or more heaters to heat the canopy.

11. An infant care unit comprising: a support for an infant, a heater supported above the support to directly radiate heat to the infant, and a canopy moveably supported on the heater to a first position directly below the heater to cover the infant to provide a controlled environment and to a retracted position away from the first position allowing the heater to directly warm the infant, the heater being configured to directly warm the canopy to reduce radiation heat loss from the infant when the canopy is in the first position.

12. The infant care unit of claim 11, wherein the heater is positioned outside the controlled environment and directed to the canopy.

13. The infant care unit of claim 11, wherein the canopy comprises two portions, each movable between the first position to form the controlled environment and the retracted position to expose the infant.

14. The infant care unit of claim 13, wherein the heater is configured to warm the infant when the two portions are moved to the retracted position.

15. An infant care unit comprising a platform on which an infant may rest, a moveable canopy having an infrared absorbing panel supported above the platform and moveable to a first position cooperating with the platform to define a chamber, and heater supported above the platform and configured to directly warm the canopy when the canopy is moved to the first position, and means to retract the canopy from the first position to allow the heater to directly heat an infant who may rest on the platform.

16. The infant care unit of claim 15, wherein the canopy is movable relative to the platform, and the heater moves with the canopy when the canopy moves relative to the platform.

17. The infant care unit of claim 16, wherein the canopy is movable independent of the heater between a use position and a retracted position.

18. The infant care unit of claim 17, wherein the canopy comprises two portions, each movable independent of the heater between the use position and the retracted position.

19. The infant care unit of claim 17, wherein the heater is directed toward the infant when the canopy is in the retracted position.

20. An infant care unit comprising a platform on which an infant may rest, a heater, a canopy having an upper portion over the platform and moveable to cover the platform from a position at least partially above the heater, the heater controlled to direct heat to a top surface of an upper portion of the canopy to warm the upper portion when the canopy covers the platform and wherein the top surface faces away from the platform.

21. The infant care unit of claim 10 wherein the canopy has at least two separate parts, each pivotedly mounted for movement between a retracted position and the position covering the platform.

* * * * *